US009640889B2

(12) United States Patent
Dubniczki et al.

(10) Patent No.: US 9,640,889 B2
(45) Date of Patent: May 2, 2017

(54) ELECTRICAL CONNECTOR HAVING ELECTRICAL CONTACTS THAT INCLUDE A PRECIOUS METAL PLATING

(71) Applicant: Tyco Electronics Corporation, Berwyn, PA (US)

(72) Inventors: George J. Dubniczki, Mechanicsburg, PA (US); Daniel Briner Shreffler, Mechanicsburg, PA (US); Raymond Dennis Boyer, Mechanicsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 21 days.

(21) Appl. No.: 14/690,932

(22) Filed: Apr. 20, 2015

(65) Prior Publication Data

US 2016/0308295 A1 Oct. 20, 2016

(51) Int. Cl.

| | |
|---|---|
| ***H01R 9/24*** | (2006.01) |
| ***H01R 13/03*** | (2006.01) |
| ***H01R 12/71*** | (2011.01) |
| ***H01R 13/04*** | (2006.01) |
| *H01R 107/00* | (2006.01) |
| *H01H 1/06* | (2006.01) |
| *H01R 12/73* | (2011.01) |

(Continued)

(52) U.S. Cl.

CPC ..... *H01R 13/03* (2013.01); *H01R 12/712* (2013.01); *H01R 13/04* (2013.01); *H01H 1/06* (2013.01); *H01R 12/737* (2013.01); *H01R 13/111* (2013.01); *H01R 13/114* (2013.01); *H01R 43/16* (2013.01); *H01R 2107/00* (2013.01)

(58) Field of Classification Search

USPC ..... 439/524, 886

See application file for complete search history.

(56) References Cited

U.S. PATENT DOCUMENTS 5,230,632 A * 7/1993 Baumberger ..... H01R 13/03 439/591

8,188,392 B2 * 5/2012 Isberg ..... H01H 1/06 200/279

(Continued)

FOREIGN PATENT DOCUMENTS

| | | |
|---|---|---|
| EP | 2752945 | 7/2014 |
| EP | 2816669 | 12/2014 |

(Continued)

OTHER PUBLICATIONS

International Search Report dated Jul. 21, 2016 received in International Application No. PCT/US2016/028234.

*Primary Examiner* — Tho D Ta

(57) ABSTRACT

Electrical connector includes a connector housing configured to engage a mating connector during a mating operation. The electrical connector also includes a plurality of electrical contacts coupled to the connector housing. Each of the electrical contacts includes a proximal base coupled to the connector housing and an elongated body that extends from the proximal base to a distal end. The elongated body includes an outer plating that comprises a precious metal. The outer plating forms interstitial regions that define an array of cavities. The interstitial regions form an exterior surface of the corresponding electrical contact that engages a corresponding contact of the mating connector during the mating operation.

20 Claims, 7 Drawing Sheets

(51) Int. Cl.
*H01R 13/11* (2006.01)
*H01R 43/16* (2006.01)

(56) References Cited

U.S. PATENT DOCUMENTS 8,579,636 B2 * 11/2013 Davis ..... H01R 12/7082 439/65
2013/0210246 A1 8/2013 Davis et al.

FOREIGN PATENT DOCUMENTS

EP 2894722 7/2015
WO 2014038617 3/2014

* cited by examiner

ELECTRICAL CONNECTOR HAVING ELECTRICAL CONTACTS THAT INCLUDE A PRECIOUS METAL PLATING

BACKGROUND OF THE INVENTION

The subject matter herein relates generally to electrical connectors having electrical contacts that engage corresponding mating contacts of another electrical connector.

Electrical connectors are used to transmit data and/or power in various industries. The electrical connectors are often configured to repeatedly engage and disengage complementary electrical connectors. The process of mating the electrical connectors may be referred to as a mating operation. For example, in a backplane communication system, a backplane circuit board has a header connector that is configured to mate with a receptacle connector. The receptacle connector is typically mounted to a daughter card. The header connector includes an array of electrical contacts (hereinafter referred to as "header contacts"), and the receptacle connector includes a complementary array of electrical contacts (hereinafter referred to as "receptacle contacts"). During the mating operation, the receptacle contacts engage and slide along the corresponding header contacts. The sliding engagement between the receptacle and header contacts may be referred to as wiping, because each receptacle contact wipes along an exterior surface of the corresponding header contact.

Electrical contacts are often plated to enhance performance and/or durability of the electrical contact. Electrical contacts used to transmit data signals typically include one or more underlying materials and a plating disposed on the underlying materials. The outer plating is often a precious metal, such as gold, and is configured to impede corrosion while being sufficiently conductive for achieving the desired electrical performance. Plating material, however, that comprises gold or other precious metals can be expensive. But using less plating material to reduce costs can be problematic and may negatively affect electrical performance.

Accordingly, a need remains for electrical contacts that require less plating material, such as gold and/or other precious metal, while achieving a sufficient level of electrical performance.

BRIEF DESCRIPTION OF THE INVENTION

In an embodiment, an electrical connector is provided that includes a connector housing configured to engage a mating connector during a mating operation. The electrical connector also includes a plurality of electrical contacts coupled to the connector housing. Each of the electrical contacts includes a proximal base coupled to the connector housing and an elongated body that extends from the proximal base to a distal end. The elongated body includes an outer plating that comprises a precious metal. The outer plating forms interstitial regions that define an array of cavities. The interstitial regions form an exterior surface of the corresponding electrical contact that engages a corresponding contact of the mating connector during the mating operation.

In an embodiment, a communication system is provided that includes a receptacle connector having a plurality of receptacle contacts a header connector having a plurality of header contacts that are configured to engage corresponding receptacle contacts of the receptacle connector during a mating operation between the receptacle and header connectors. Each of the header contacts includes a proximal base and an elongated body that extends from the proximal base to a distal end. The elongated body includes an outer plating that comprises a precious metal. The outer plating forms interstitial regions that define an array of cavities. The interstitial regions form an exterior surface of the corresponding header contact that engages the corresponding receptacle contact of the receptacle connector during the mating operation.

In an embodiment, an electrical contact is provided that includes a proximal base and an elongated body that extends from the proximal base to a distal end. The elongated body includes an outer plating that comprises a precious metal. The outer plating forms interstitial regions that define an array of cavities. The interstitial regions form an exterior surface of the elongated body that is configured to engage a corresponding contact through a wiping action.

DETAILED DESCRIPTION OF THE INVENTION

Embodiments set forth herein include electrical contacts, electrical connectors having the electrical contacts, and communication systems having the electrical connectors. Embodiments include electrical contacts that may have less plating material than at least some conventional electrical contacts. Although the illustrated embodiment includes electrical connectors that are used in high-speed communication systems, such as backplane or midplane communication systems, it should be understood that embodiments may be used in other communication systems or in other systems/devices that utilize electrical contacts. Accordingly, the inventive subject matter is not limited to the illustrated embodiment.

In order to distinguish similar elements in the detailed description and claims, various labels may be used. For example, an electrical connector may be referred to as a header connector, a receptacle connector, or a mating connector. Electrical contacts may be referred to as header contacts, receptacle contacts, or mating contacts. When similar elements are labeled differently (e.g., header contacts, receptacle contacts, mating contacts, etc.), the different labels do not necessarily require structural differences. For instance, in some embodiments, the header contacts described herein may be referred to as mating contacts.

As used herein, the phrase "a plurality of electrical contacts," when used in the detailed description or the claims, does not necessarily refer to each and every electrical contact of an electrical connector. For example, a contact array may include a first plurality of electrical contacts and a second plurality of electrical contacts. The first plurality may have certain features, such as patterned outer platings as described herein, that the second plurality does not have.

Figure 1:
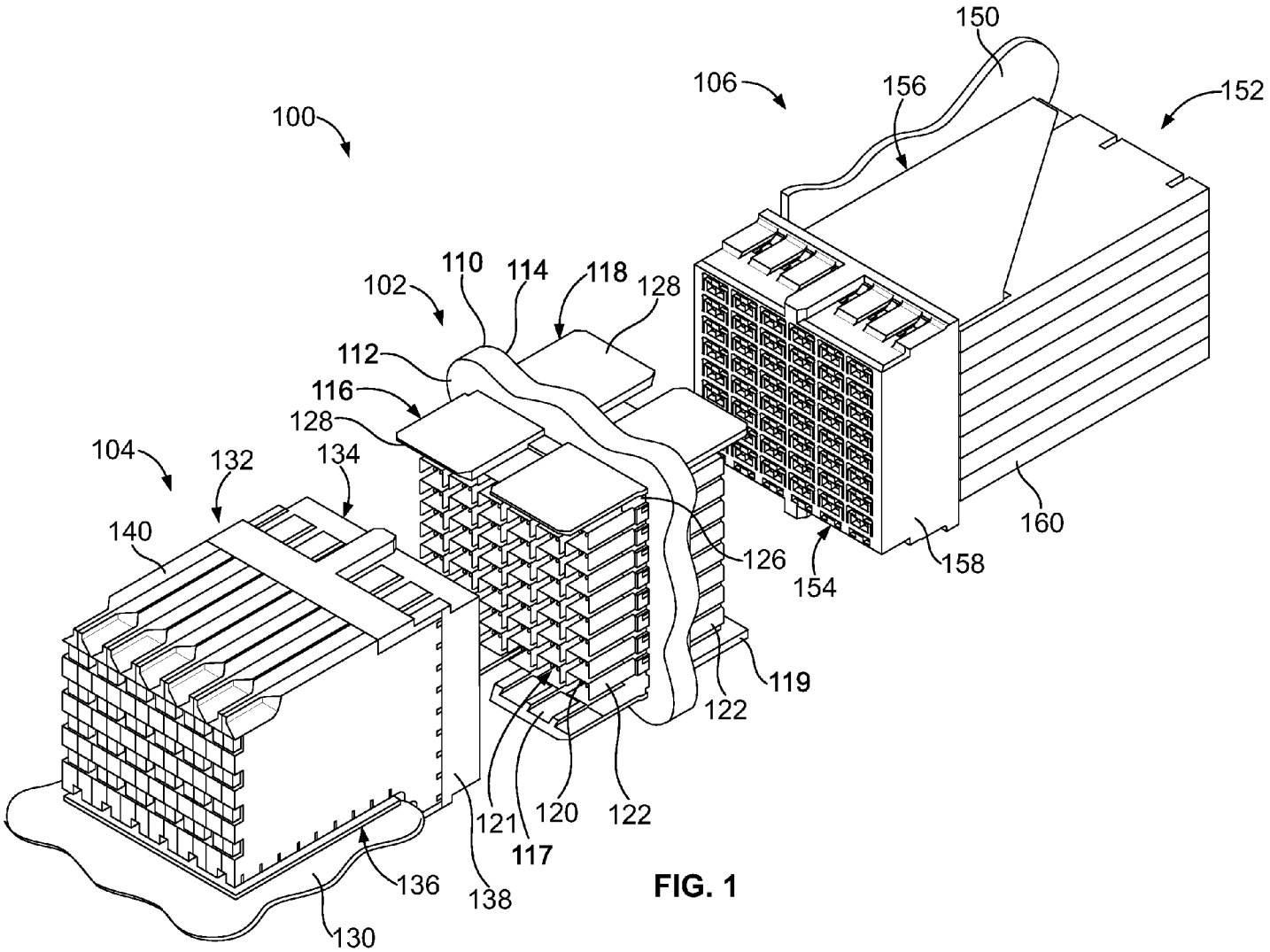
FIG. 1 is a front perspective view of a communication system formed in accordance with an embodiment.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102 and a second connector system (or assembly) 106 configured to be coupled to an opposite side the circuit board assembly 102. The circuit board assembly 102 is used to electrically connect the first and second connector systems 104, 106. Optionally, the first and second connector systems 104, 106 may be line cards or switch cards. Although the communication system 100 is configured to interconnect two connector systems in the illustrated embodiment, other communication systems may interconnect more than two connector systems or, alternatively, interconnect a single connector system to another communication device.

The communication system 100 may be used in various applications. By way of example only, the communication system 100 may be used in telecom and computer applications, routers, servers, supercomputers, and uninterruptible power supply (UPS) systems. One or more of the electrical connectors described herein may be similar to electrical connectors of the STRADA Whisper or Z-PACK TinMan product lines developed by TE Connectivity. The electrical connectors may be capable of transmitting data signals at high speeds, such as 10 gigabits per second (Gb/s), 20 Gb/s, 30 Gb/s, or more. In more particular embodiments, the electrical connectors may be capable of transmitting data signals at 40 Gb/s, 50 Gb/s, or more. The electrical connectors may include high-density arrays of electrical contacts. A high-density array may have, for example, at least 12 electrical contacts per 100 $mm^2$ along the mating side or the mounting side of the electrical connector. In more particular embodiments, the high-density array may have at least 20 electrical contacts per 100 $mm^2$.

The circuit board assembly 102 includes a circuit board 110 having a first board side 112 and second board side 114. In some embodiments, the circuit board 110 may be a backplane circuit board, a midplane circuit board, or a motherboard. The circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. The first and second header connectors 116, 118 include connector housings 117, 119, respectively. The first and second header connectors 116, 118 also include corresponding electrical contacts 120 that are electrically connected to one another through the circuit board 110. The electrical contacts 120 are hereinafter referred to as header contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides.

The connector housings 117, 119 couple to and hold the header contacts 120 and the ground shields 122 in designated positions relative to each other. The connector housings 117, 119 may be manufactured from a dielectric material, such as a plastic material. Each of the connector housings 117, 119 includes a mounting wall 126 that is configured to be mounted to the circuit board 110 and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is oriented perpendicular to the mating interface 134. When the first receptacle connector 132 is coupled to the first header connector 116, the first circuit board 130 is oriented perpendicular to the circuit board 110.

The first receptacle connector 132 includes a front housing or shroud 138. The front housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (shown in FIGS. 3 and 4) that are electrically connected to the first circuit board 130. The electrical contacts 142 are hereinafter referred to as receptacle contacts 142. The receptacle contacts 142 are configured to be electrically connected to the header contacts 120 of the first header connector 116.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is oriented perpendicular to the mating interface 154. When the second receptacle connector 152 is coupled to the second header connector 118, the second circuit board 150 is oriented perpendicular to the circuit board 110.

Figure 3:
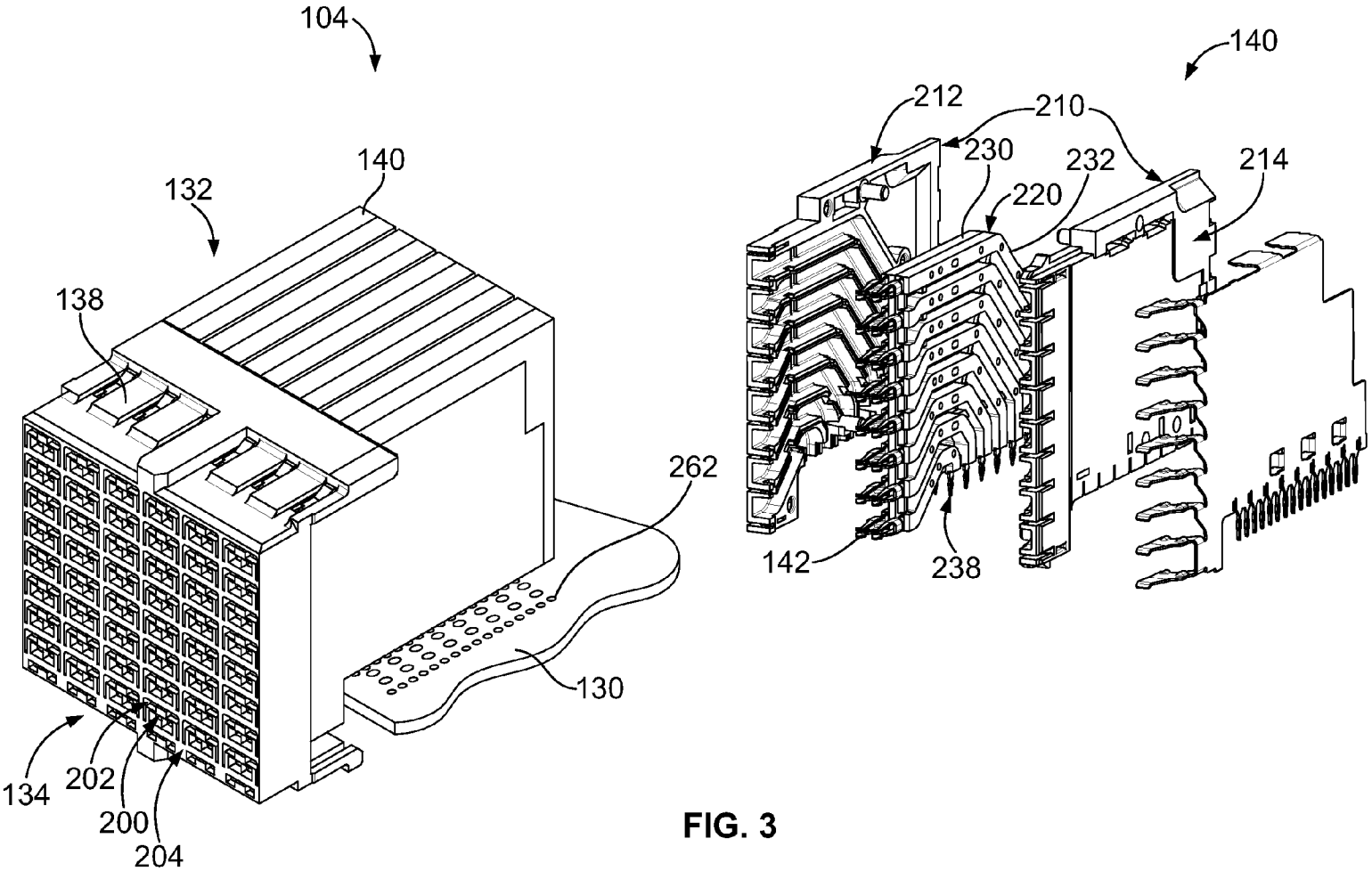
FIG. 3 is a perspective view of a receptacle connector that may be used with the communication system of FIG. 1.

Similar to the first receptacle connector 132, the second receptacle connector 152 includes a front housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142 (FIG. 3).

In the illustrated embodiment, the first circuit board 130 is oriented generally horizontally. The contact modules 140 of the first receptacle connector 132 are oriented generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

Figure 2:
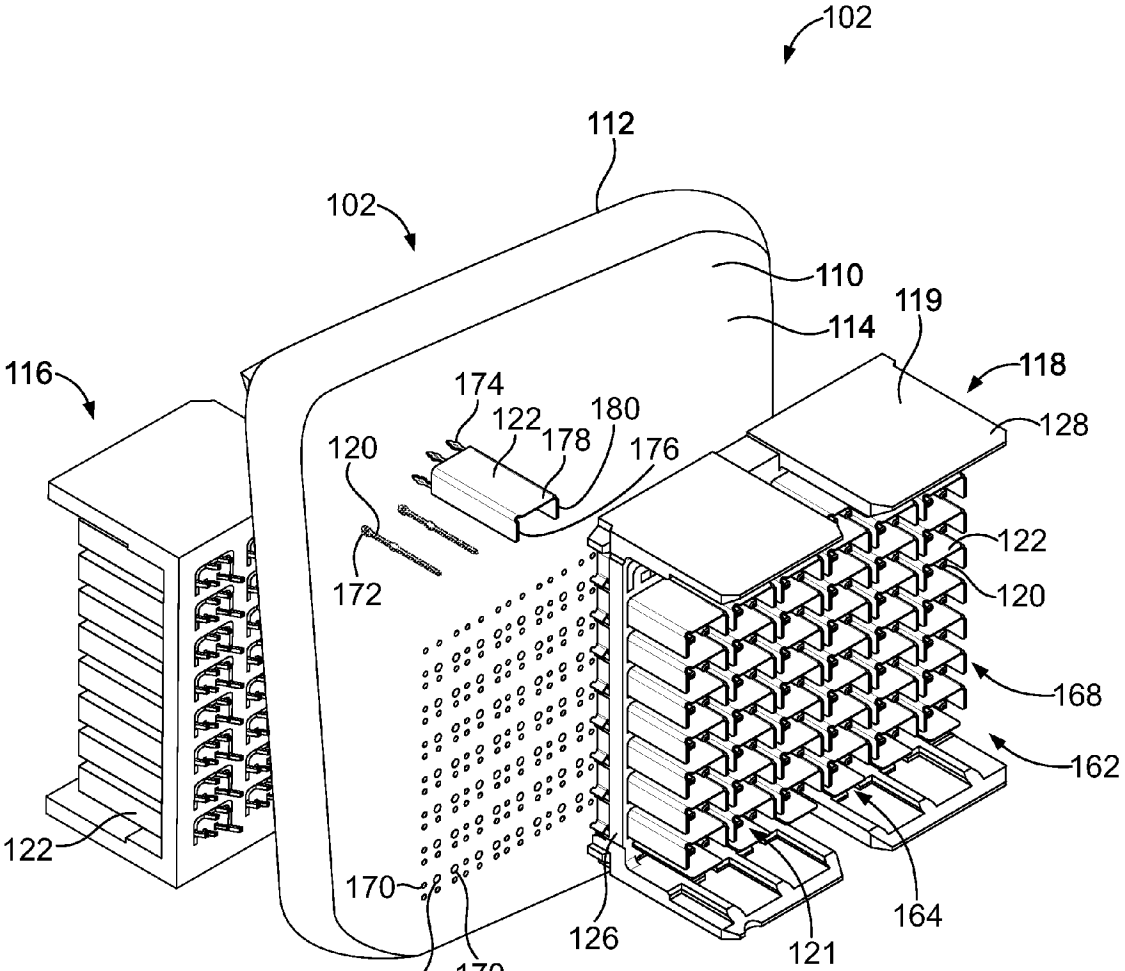
FIG. 2 is a perspective view of a circuit board assembly including a header connector that may be used with the communication system of FIG. 1.

FIG. 2 is a partially exploded view of the circuit board assembly 102 showing the first and second header connectors 116, 118 positioned for mounting to the circuit board 110. Although the following description is with respect to the second header connector 118, the description is also applicable to the first header connector 116. As shown, the connector housing 119 includes a front end 162 that faces away from the second board side 114 of the circuit board 110. The connector housing 119 defines a housing cavity 164 that opens to the front end 162 and is configured to receive the second receptacle connector 152 (FIG. 1) when the second receptacle connector 152 is advanced into the housing cavity 164. As shown, the second header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120.

The ground shields 122 are C-shaped and provide shielding on three sides of the signal pair 121. The ground shields 122 have a plurality of walls, such as three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

FIG. 3 is a partially exploded view of the first connector system 104 including the first receptacle connector 132. Although the following description is with respect to the first receptacle connector 132, the description is also applicable to the second receptacle connector 152 (FIG. 1). FIG. 3 illustrates one of the contact modules 140 in an exploded state. The front housing 138 includes a plurality of contact openings 200, 202 at a front end 204 of the front housing 138. The front end 204 defines the mating interface 134 of the first receptacle connector 132 that engages the first header connector 116 (FIG. 1).

The contact modules 140 are coupled to the front housing 138 such that the receptacle contacts 142 are received in corresponding contact openings 200. Optionally, a single receptacle contact 142 may be received in each contact opening 200. The contact openings 200 may be configured to receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

The front housing 138 may be manufactured from a dielectric material, such as a plastic material, and may provide isolation between the contact openings 200 and the contact openings 202. The front housing 138 may isolate the receptacle contacts 142 and the header contacts 120 from the ground shields 122. In some embodiments, the contact module 140 includes a conductive holder 210. The conductive holder 210 may include a first holder member 212 a second holder member 214 that are coupled together. The holder members 214, 214 may be fabricated from a conductive material. As such, the holder members 214, 214 may provide electrical shielding for the first receptacle connector 132. When the holder members 214, 214 are coupled together, the holder members 214, 214 define at least a portion of a shielding structure.

The conductive holder 210 is configured to support a frame assembly 220 that includes a pair of dielectric frames 230, 232. The dielectric frames 230, 232 are configured to surround signal conductors (not shown) that are electrically coupled to or include the receptacle contacts 142. Each signal conductor may also be electrically coupled to or may include a mounting contact 238. The mounting contacts 238 are configured to mechanically engage and electrically couple to conductive vias 262 of the first circuit board 130. Each of the receptacle contacts 142 may be electrically coupled to a corresponding mounting contact 238 through the signal conductor (not shown).

Figure 4:
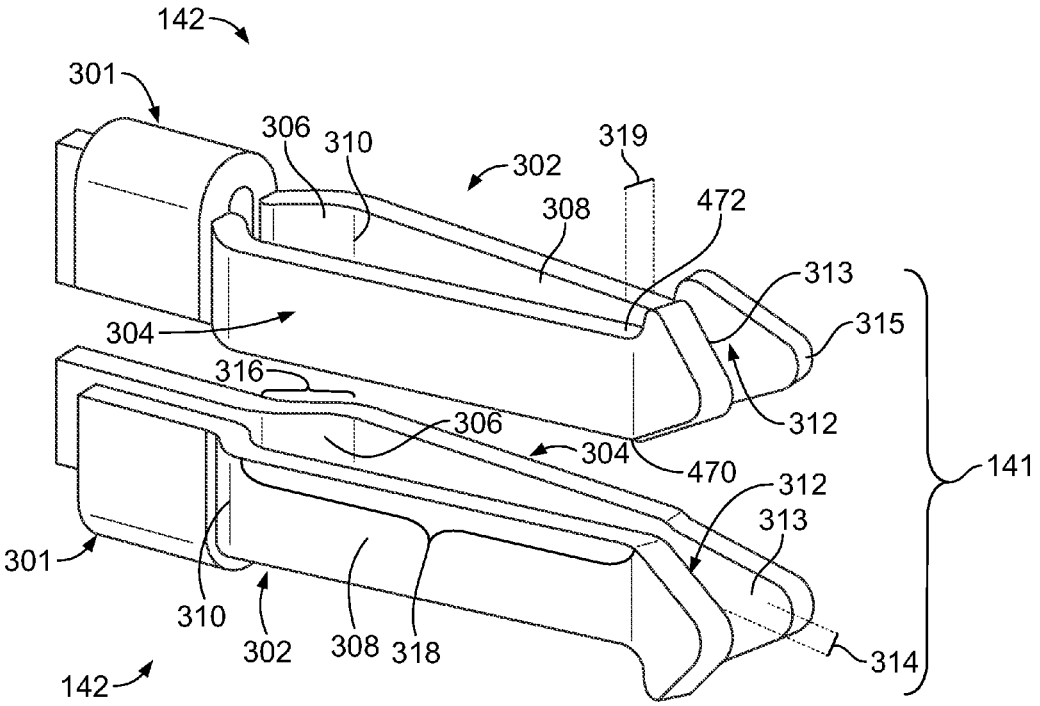
FIG. 4 is an isolated view of receptacle contacts that may be used with the receptacle connector of FIG. 3.

FIG. 4 is an isolated perspective view of a signal pair 141 of two receptacle contacts 142. Each of the receptacle contacts 142 of the signal pair 141 is configured to mechanically and electrically engage a corresponding header contact 120 (FIG. 1) of the same signal pair 121 (FIG. 1). Each of the receptacle contacts 142 may be stamped from a common sheet of material and be shaped to include a proximal base 301 and a pair of elongated bodies 302, 304. The proximal base 301 may be coupled directly or indirectly to the connector housing, such as the front housing 138 (FIG. 3). The elongated bodies are hereinafter referred to as contact fingers 302, 304. Each of the contact fingers 302, 304 projects from the same proximal base 301 to a respective distal end or tip 315.

In the illustrated embodiment, the receptacle contacts 142 are identical. As such, the following description is applicable to each of the receptacle contacts 142. It should be understood, however, that the receptacle contacts 142 of the signal pair 141 are not required to be identical. It should also be understood that the receptacle contacts 142 of the corresponding receptacle connector are not required to be identical. For example, in some embodiments, the receptacle contacts may be configured differently so that the receptacle contacts electrically engage the corresponding header contacts at different times during the mating operation.

Each of the contact fingers 302, 304 includes a base portion 306, a beam portion 308, and a joint portion 310 located between the base and beam portions 306, 308. Each of the contact fingers 302, 304 also includes a flared portion 313. The beam portions 308 extend from corresponding joint portions 310 to respective mating interfaces 312, which are defined between opposite edge portions 470, 472. The mating interfaces 312 of the contact fingers 302, 304 face each other with a contact-receiving gap 314 therebetween. The mating interface 312 forms an inflection area of the corresponding contact finger. More specifically, the beam portions 308 converge toward each other and the flared portions 313 diverge from each other. The mating interfaces 312 may represent the areas of the contact fingers 302, 304 that are closest to each other. The flared portions 313 extend away from the opposing mating interface 312 to enlarge the contact-receiving gap 314. The mating interfaces 312 and the flared portions 313 may facilitate receiving one of the header contacts 120 (FIG. 1) within the contact-receiving gap 314. The contact fingers 302, 304 are flexible and can be deflected away from each other when one of the header contacts 120 is inserted into the contact-receiving gap.

In FIG. 4, the contact fingers 302, 304 are in a relaxed condition or state. During a mating operation between, for example, the first header connector 116 (FIG. 1) and the first receptacle connector 132 (FIG. 1), each of the header contacts 120 (FIG. 1) is received within a contact-receiving gap 314 of a corresponding receptacle contact 142. The opposing mating interfaces 312 may engage opposite body sides of the header contact 120 and slide therealong. The process of sliding along the header contact 120 during the mating operation is referred to as a wiping action or operation.

When the contact fingers 302, 304 are in deflected conditions, each of the contact fingers 302, 304 generates a normal force that presses the corresponding mating interface 312 against the corresponding header contact 120 in a direction toward the other mating interface 312. As such, the contact fingers 302, 304 may pinch the corresponding header contact 120 therebetween. To this end, each of the contact fingers 302, 304 may be configured to provide a designated normal force when the corresponding contact finger is in a deflected condition. For example, the base portion 306 may have a designated length 316, the beam portion 308 may have a designated length 318, and the joint portion 310 may have a designated shape or contour. Each of the contact fingers 302, 304 may also have a designated thickness 319. In an exemplary embodiment, the thickness 319 is substantially uniform throughout the corresponding contact finger. The lengths 316, 318, the shape of the joint portion 310, and the thickness 319 may be configured such that each of the contact fingers 302, 304 provides a designated normal force against the header contact 120. The lengths 316, 318 and the shape of the joint portion 310 may also be configured to locate the mating interface 312 at a designated location along the header contact 120 (FIG. 1).

Figure 5:
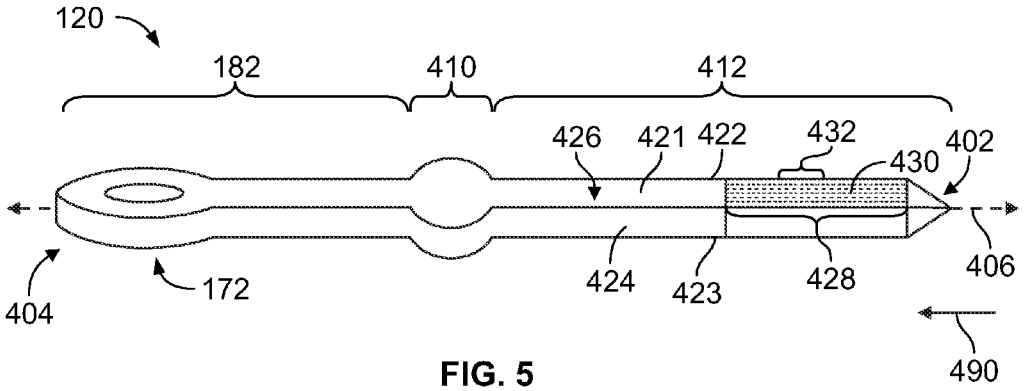
FIG. 5 is an isolated view of a header contact that may be used with the header connector of FIG. 2.

FIG. 5 is an isolated view of an exemplary header contact 120. The header contact 120 includes a distal end or tip 402 and a board end or tail 404. The board end 404 is configured to engage the circuit board 110 (FIG. 1). The distal end 402 may represent the portion of the header contact 120 that is located furthest from the circuit board 110 or the mounting wall 126 (FIG. 1) and is first to engage or interface with another electrical connector, such as the second receptacle connector 152 (FIG. 1). As shown, the header contact 120 has a longitudinal axis 406 extending therethrough between the board end 404 and the distal end 402. For reference, the longitudinal axis 406 extends through an approximate center of the header contact 120.

The header contact 120 may include a contact tail 182 that has the compliant pin 172. The header contact 120 also includes a proximal base 410 that couples to the contact tail 182, and an elongated body 412 that extends from the proximal base 410 to the distal end 402. The contact tail 182 includes the board end 404, and the elongated body 412 includes the distal end 402. As described above, the compliant pin 172 mechanically engages and electrically couples to a corresponding conductive via 170 (FIG. 2) of the circuit board 110 (FIG. 1). The proximal base 410 is sized and shaped to mechanically engage the mounting wall 126 (FIG. 1). For example, the proximal base 410 may be inserted into a passage (not shown) that extends through the mounting wall 126 and engage the mounting wall 126 to form an interference fit therewith. The elongated body 412 may represent the portion of the header contact 120 that is exposed within the housing cavity 164 (FIG. 2).

In the illustrated embodiment, the header contact 120 has a linear structure from the board end 404 to the distal end 402. In other embodiments, however, the header contact 120 may not be linear from the board end 404 to the distal end 402. For example, the elongated body 412 may be linear and extend along the longitudinal axis 406 between the distal end 402 and the proximal base 410 as shown in FIG. 5, but the proximal base 410 may be shaped to reposition the contact tail 182 such that the contact tail 182 is not co-linear with the elongated body 412. In such embodiments, the proximal base 410 may be shaped to facilitate engaging the mounting wall 126 and/or positioning the compliant pin 172 at a designated location. In alternative embodiments, the elongated body 412 is non-linear. For example, the elongated body 412 may have a shape similar to the shape of contact finger 302 (FIG. 4).

In the illustrated embodiment, the elongated body 412 includes body sides 421, 422, 423, 424 that extend generally along the longitudinal axis 406 between the proximal base 410 and the distal end 402. The body sides 421-424 may be exposed within the housing cavity 164 (FIG. 1). The body sides 422, 424 face in opposite directions, and the body sides 421, 423 face in opposite directions. The body side 421 has a side surface 426.

The body side 421 is configured to engage a corresponding contact finger, such as one of the contact fingers 302, 304 (FIG. 4), along a wipe track 428 of the side surface 426. For example, during the mating operation, the mating interface 312 (FIG. 4) of the corresponding contact finger may engage the wipe track 428 proximate to the distal end 402 and slide (or "wipe") along the wipe track 428 in a mating direction 490 that is parallel to the longitudinal axis 406.

In the illustrated embodiment, the wipe track 428 includes an outer plating 430 that is patterned to include an array of cavities and interstitial regions as described below. The interstitial regions are configured to engage one of the contact fingers 302, 304 during the mating operation. In the illustrated embodiment, the outer plating 430 is located along the body side 421 and not along the body side 424. Optionally, the outer plating 430 may also be located along the body side 423. In other embodiments, the outer plating 430 may be located along only one of the body sides 421-424 or more than two of the body sides 421-424.

The wipe track 428 includes a contact zone 432 that represents an area along the body side 421 that is configured to engage the corresponding contact finger after the corresponding receptacle and header connectors are fully mated. More specifically, the contact zone 432 may represent the area that includes the operating position (or final resting position) of the mating interface 312 (FIG. 4) as data signals are transmitted through the communication system 100 (FIG. 1). In order to account for tolerances in the manufacturing and assembly of the receptacle and header connectors, the wipe track 428 and/or the outer plating 430 may have a longer axial length than the contact zone 432. The contact zone 432 may have a longer axial length than the mating interface 312.

Figure 6:
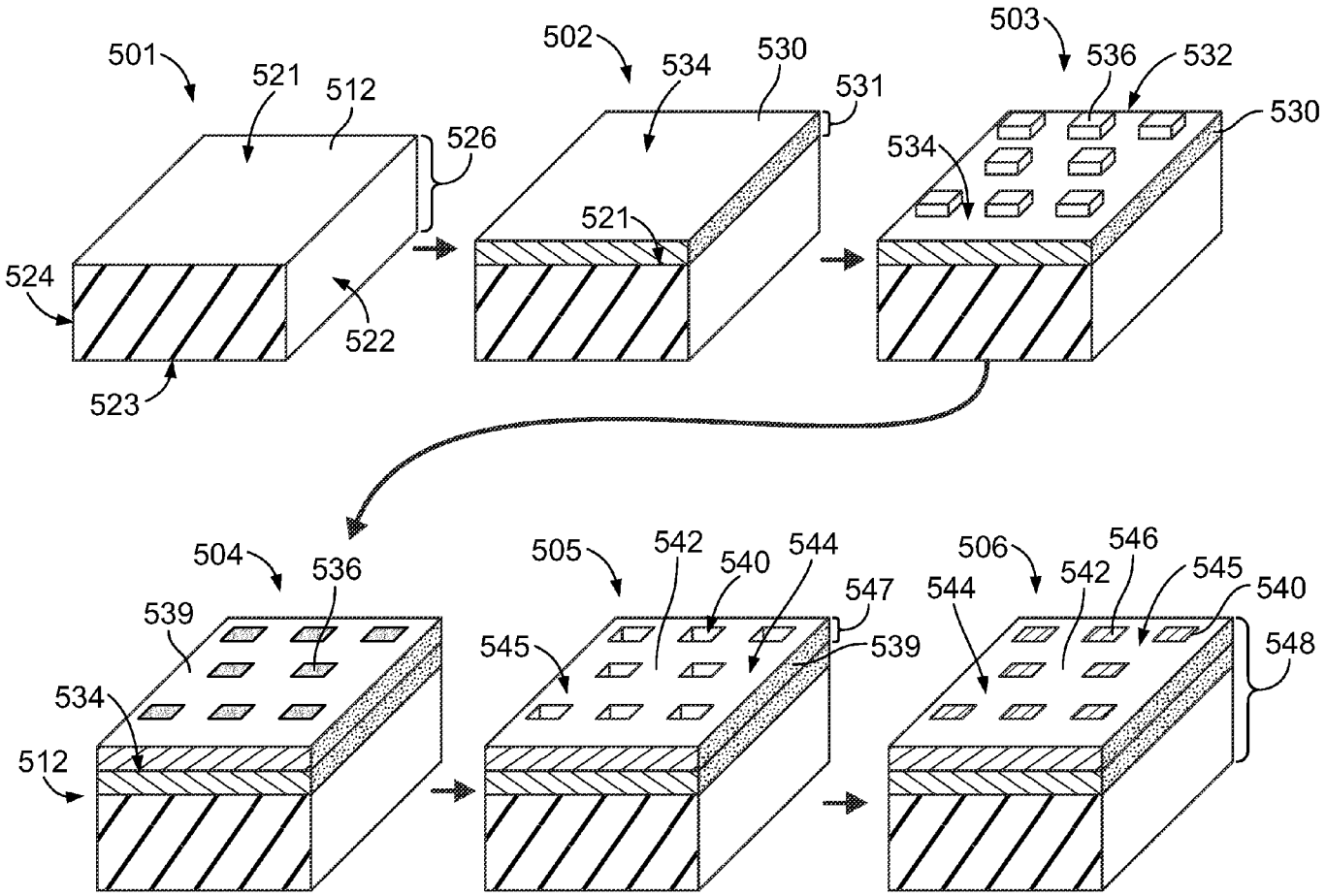
FIG. 6 illustrates different stages for manufacturing electrical contacts formed in accordance with an embodiment.

FIG. 6 illustrates different stages during the manufacture of an exemplary header contact 548, which may be similar or identical to the header contact 120 (FIG. 1). Only a portion of the header contact 548 is shown in FIG. 6. At different stages of manufacturing, the incomplete header contact will be referred to as a contact body. It should be understood that the following description does not necessarily describe each stage (or step) of the manufacturing process and that additional stages may be performed depending upon application. For example, one or more rinsing stages may be performed to remove extraneous or unwanted material.

During a first stage 501, a contact body 512 is stamped (or coined) from sheet metal to form body sides 521, 522, 523, 524. The body sides 521-524 may correspond to the body sides 421-424 (FIG. 5) without the outer plating 430 (FIG. 5) and other underlying layer(s). The body sides 521, 523 face in opposite directions and define a thickness 526 of the contact body 512. The body sides 521, 523 may be formed from opposite side surfaces of the sheet metal. The body sides 522, 524 face in opposite directions and constitute stamped edges. In an exemplary embodiment, the contact body 512 may comprise a copper alloy.

During a second stage 502, an underplate coating 530 may be applied to the body side 521. Although not shown, the underplate coating 530 may also be applied to the other body sides 522, 523, 524. The underplate coating 530 forms an underlying layer upon which other coatings or materials may be applied. In an exemplary embodiment, the underplate coating 530 comprises nickel and/or tin and functions as a diffusion barrier between the contact body 512 and subsequent coatings. The underplate coating 530 has a coating or layer surface 534 and has a thickness 531 that is measured between the coating surface 534 and the body side 521.

During a third stage 503, a chemical mask 532 may be applied to the coating surface 534 of the underplate coating 530. As shown in FIG. 6, the chemical mask 532 includes an array of mask elements or deposits 536. In some embodiments, the mask elements 536 may be formed by applying a layer of mask material and then selectively removing the mask material, such as through laser ablation, to form the mask elements 536. The mask elements 536 may comprise a resist material and cover localized areas along the coating surface 534 of the underplate coating 530. Accordingly, after the mask material has been removed at the third stage 503, the contact body 512 includes the coating surface 534 having an array of the mask elements 536.

During a fourth stage 504, a plating material 539 may be applied to the exposed coating surface 534. The plating material 539 may comprise gold, gold alloy and/or another precious metal (e.g., palladium, palladium alloy silver, or silver alloy). For example, the plating material 539 may be applied to the coating surface 534 using an electroplating process in which the contact body 512 from the third stage 503 is bathed within an electrolytic solution that includes metal ions. The plating material 539 may be deposited along exposed portions of the coating surface 534. Due to the mask elements 536, however, the plating material 539 is not applied to the areas where the mask elements 536 are located. A thickness of the plating material 539 may be based on the metal in the plating. For example, a flash layer comprising gold, gold alloy, palladium, or palladium alloy may be from about 2 to about 10 microinches (or about 50.8 nm to about 254 nm). A flash layer comprising silver or silver alloy may be from about 2 to about 30 microinches (or about 50.8 nm to about 762 nm).

During a fifth stage 505, the mask elements 536 may be removed. The mask elements 536 may be removed through, for example, chemical etching. After the mask elements 536 are removed, the spaces occupied by the mask elements 536 become cavities 540 and the portions of the plating material 539 become interstitial regions 542. In this patterned state, the plating material 539 forms an outer plating 545 of the header contact 548. The outer plating 545 has a non-uniform thickness 547 as described below.

The interstitial regions 542 surround the cavities 540 and, thereby, separate the cavities 540 from one another. In the illustrated embodiment, the interstitial regions 542 are interconnected to one another. In other embodiments, however, the interstitial regions 542 may be separated from each other by the cavities 540. For example, the cavities 540 may be grooves or channels that extend across the header contact 548 and separate the interstitial regions 542. The interstitial regions 542 collectively form an exterior surface or side 544 of the corresponding header contact 548.

During a sixth stage 506, a pore-blocking substance 546 may be coated onto the outer plating 545 such that the pore-blocking substance 546 is deposited within the cavities 540 and along the interstitial regions 542. Various methods may be used to apply the pore-blocking substance 546, such as spraying, brushing, dipping, and the like. The pore-blocking substance 546 is configured to reduce corrosion along the exterior surface 544. In some cases, the pore-blocking substance 546 may also function as or be substituted with a lubricant. Examples of pore-blocking substances that may be used with embodiments described herein include at least one of a polysiloxane (e.g. dimethyl polysiloxane, phenylmethyl polysiloxane), silicate ester, polychlorotrifluoro-ethylene, di-ester, fluorinated ester, glycol, chlorinated hydrocarbon, phosphate ester, polyphenyl ether, perfluoroalkyl polyether, poly-alpha-olefin, petroleum oil, organometallic compound, benzotriazole (BTA), mercaptobenzotriazole, self-assembled monolayer (SAM), or microcrystalline wax. Proprietary pore-blocking substances may also be used, such as D-5026NS/ZC-026 by Zip-Chem. It should be understood that the pore-blocking substances are provided above as non-limiting examples and other pore-blocking substances may be used. Moreover, a combination of pore-blocking substances, such as those provided above, may be used. It should also be understood that certain pore-blocking substances may not be suitable for some applications.

Optionally, a flash layer or strike layer (not shown) may be applied to the contact body 512 after the fifth stage 505, but prior to the pore-blocking substance 546 being applied during the sixth stage 506. The flash layer may be a thin layer of a precious metal, such as gold. The flash layer may be deposited along the exterior surface 544 and surfaces that define the cavities 540. The flash layer may provide a diffusion barrier between the underplate coating 530 and the exterior surface 544.

It should be understood that FIG. 6 illustrates only one exemplary method for manufacturing an electrical contact having an outer plating that is patterned to include cavities and interstitial regions. The outer plating, however, may be obtained using other steps or stages during the manufacturing process. Other additive techniques may be used for applying the different layers, and other subtractive techniques may be used to pattern the outer plating. For example, a laser may be incident upon the outer plating to remove selected portions of the outer plating. In some embodiments, the removed material may be reclaimed.

Various techniques may be used to form a designated pattern of resist along an outer plating. For example, in graver wheel printing, a resist material is applied to a patterned wheel. The wheel is rolled over the outer plating to transfer the resist to the outer plating at designated locations. In pad printing, a patterned stamp having resist material located at designated areas may be stamped onto the outer plating to transfer the resist material to the outer plating at designated locations. In ink-jet printing, an ink-jet printer may apply a resist to designated locations along the outer plating. In controlled-spray printing, a resist may be sprayed onto an outer plating at designated locations.

Figure 7:
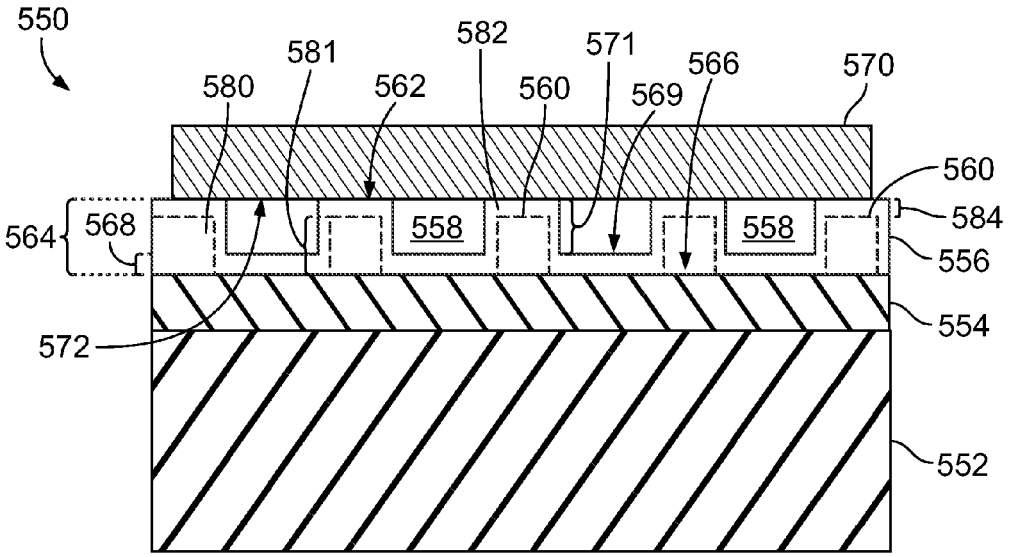
FIG. 7 is an enlarged cross-section of an electrical contact formed in accordance with an embodiment that illustrates a patterned outer plating.

FIG. 7 is a cross-section of a portion of a header contact 550 formed in accordance with an embodiment that is engaged with a contact finger (or mating contact) 570. A cross-section of the contact finger 570 is also shown in FIG. 7 and may include a mating interface 572 of the contact finger 570. The contact finger 570 and the mating interface 572 may be similar or identical to the contact finger 302 (or 304) (FIG. 4) and the mating interface 312 (FIG. 4), respectively. The header contact 550 includes a base substrate 552, an underlying layer 554 disposed along the base substrate 552, and an outer plating 556 disposed along the underlying layer 554. The base substrate 552 may be similar to the contact body 512 at the first stage 501 in FIG. 6 and may comprise, for example, a copper alloy. The underlying layer 554 may be similar to the underplate coating 530 and may comprise, for example, nickel or tin. The underlying layer 554 may also be referred to as underplating or the underplate. The outer plating 556 may comprise gold or another precious metal.

As shown in FIG. 7, the outer plating 556 includes cavities 558 and interstitial regions 560 that separate the cavities 558 from one another. The interstitial regions collectively form an exterior surface 562. The exterior surface 562 represents the portion or area of the outer plating 556 that may be engaged by the contact finger 570 or, more specifically, the mating interface 572 of the contact finger 570. The cavities 558 are defined by interior surfaces, such as a bottom surface 569, that typically do not engage the contact finger 570. For example, the mating interface 572 extends over the cavities 558.

As shown in FIG. 7, the outer plating 556 has a varying height, which is specifically indicated as a first height 564 and a second height 568. The height of the outer plating 556 may be measured with respect to the underlying layer 554 that the outer plating 556 is disposed directly on. In alternative embodiments, an additional coating (not shown) may function as the underlying layer, or the base substrate 552 may function as the underlying layer. The first and second heights 564, 568 may also be referred to as thicknesses or elevations. The first height 564 of the outer plating 556 may be based on the metal that forms the outer plating 556. For example, an outer plating comprising gold, gold alloy, palladium, or palladium alloy may have a first height from about 2 microinches to about 50 microinches (or about 50.8 nm to about 1270 nm). An outer plating comprising silver or silver alloy may have a first height from about 2 microinches to about 250 microinches (or about 50.8 nm to about 6350 nm). Although specific dimensions are recited above, the outer plating 556 may have any dimension within a range bounded by any of the maximum and minimum values described above. It is also contemplated that the outer plating 556 may have other dimensions based on the metal that forms the outer plating 556 and the application of the header contact.

As shown, the first height 564 is measured between the exterior surface 562 of the interstitial regions 560 and an interface 566 between the underlying layer 554 and the outer plating 556. The second height 568 is measured between the bottom surface 569 of the outer plating 556, which defines a bottom of the cavity 558, and the interface 566. In the illustrated embodiment, the cavities 558 are wells that are surrounded by the interstitial regions 560 and have a common depth 571 measured from the exterior surface 562 to the bottom surface 569. In some embodiments, the cavities 558 and at least portions of the exterior surface 562 may include a pore-blocking substance (not shown), such as the pore-blocking substance 546 (FIG. 6).

In some embodiments, the outer plating 556 includes a base layer 580 and a flash (or strike) layer 582 that is disposed on the base layer 580 and, optionally, portions of the underlying layer 554. An interface between the base layer 580 and the flash layer 582 is indicated by a dashed line. The base layer 580 may be formed as described above with respect to FIG. 6. More specifically, the base layer 580 may form portions of the interstitial regions 560. The base layer 580 may have a thickness (or height) 581. The thickness 581 of the base layer 580 may be based on the metal that forms the base layer 580. For example, a base layer comprising gold, gold alloy, palladium, or palladium alloy may have a thickness from about 2 microinches to about 50 microinches (or about 50.8 nm to about 1270 nm). In more particular embodiments, a base layer comprising gold, gold alloy, palladium, or palladium alloy may have a thickness from about 6 microinches to about 30 microinches (or about 152.4 nm to about 762 nm). A base layer comprising silver or silver alloy may have a thickness from about 2 microinches to about 250 microinches (or about 50.8 nm to about 6350 nm). In more particular embodiments, a base layer comprising silver or silver alloy may have a thickness from about 40 microinches to about 160 microinches (or about 1016 nm to about 4064 nm). Although specific dimensions are recited above, the base layer 580 may have any dimension within a range bounded by any of the maximum and minimum values described above. It is also contemplated that the base layer 580 may have other dimensions based on the metal that forms the base layer 580 and the application of the header contact.

After these portions of the interstitial regions 560 are formed, the flash layer 582 may be applied to the base layer 580. In some embodiments, the flash layer 582 and the base layer 580 have identical compositions (e.g., gold alloy). In other embodiments, however, the flash layer 582 and the base layer 580 may have different compositions. The flash layer 582 may have a thickness 584. The flash layer 582 may provide a diffusion barrier between the outer plating 556 and the underlying layer 554. The flash layer 582 may also provide a uniform appearance to users of the header contact 550. The thickness 584 of the flash layer 582 may be based on the metal that forms the flash layer 582. For example, a flash layer comprising gold, gold alloy, palladium, or palladium alloy may have a thickness from about 2 to about 10 microinches (or about 50.8 nm to about 254 nm). A flash layer comprising silver or silver alloy may be from about 2 to about 30 microinches (or about 50.8 nm to about 762 nm). It should be understood, however, that other embodiments may not include a flash layer.

In the illustrated embodiment, the second height 568 is about 25% of the first height 564. Other dimensions may be used such that the percentages are different. For example, in some embodiments, the second height 568 is at most 75% of the first height 564 or, more particularly, at most 60% of the first height 564. In some embodiments the second height 568 is at most 50% of the first height 564 or, more particularly, at most 45% of the first height 564. In certain embodiments, the second height 568 is at most 40% of the first height 564 or, more particularly, at most 35% of the first height 564. In particular embodiments the second height 568 is at most 30% of the first height 564 or, more particularly, at most 25% of the first height 564. In yet more particular embodiments, the second height 568 is at most 20%, at most 15%, at most 10%, or at most 5% of the first height 564. In some embodiments, the outer plating 556 does not define the bottom surface 569 of the cavity 558. In such embodiments, the bottom surface 569 may be defined by the underlying layer 554.

For example, the first height 564 may be at most 100 microinches (or 2540 nm), at most 80 microinches (or 2032 nm), at most 70 microinches (or 1778 nm), at most 65 microinches (or 1651 nm), at most 60 microinches (or 1524 nm), at most 55 microinches (or 1397 nm), or at most 50 microinches (or 1270 nm). The first height 564 may be at least 20 microinches (or 508 nm), at least 25 microinches (or 635 nm), at least 30 microinches (or 762 nm), at least 35 microinches (or 889 nm), at least 40 microinches (or 1016 nm), or at least 45 microinches (or 1143 nm). Although specific dimensions are recited above, the first height 564 may have any dimension within a range bounded by any of the maximum and minimum values described above. In particular embodiments, the first height 564 is based upon certain standards and/or regulations. For example, the first height 564 may be sufficient for satisfying MIL-G-45204 or ASTM-B-488.

In some embodiments, the cavities 558 may substantially reduce a material volume of the outer plating 556. For example, compared to a material volume of an outer plating having a uniform height (e.g., the first height 564), the cavities 558 may reduce the material volume by at least 25%. In some embodiments, the cavities 558 may reduce the material volume by at least 35%. In particular embodiments, the cavities 558 may reduce the material volume by at least 50%. In more particular embodiments, the cavities 558 may reduce the material volume by at least 75%.

Figure 8:
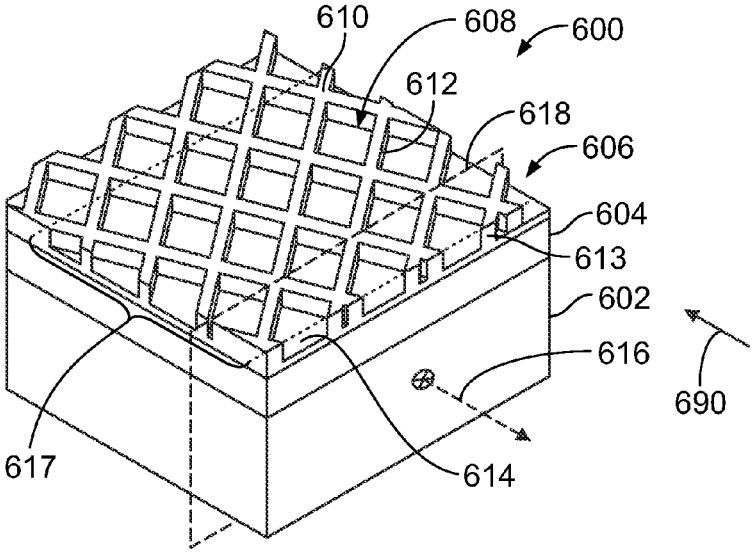
FIG. 8 is an isolated perspective view of a portion of an electrical contact formed in accordance with an embodiment.
Figure 9:
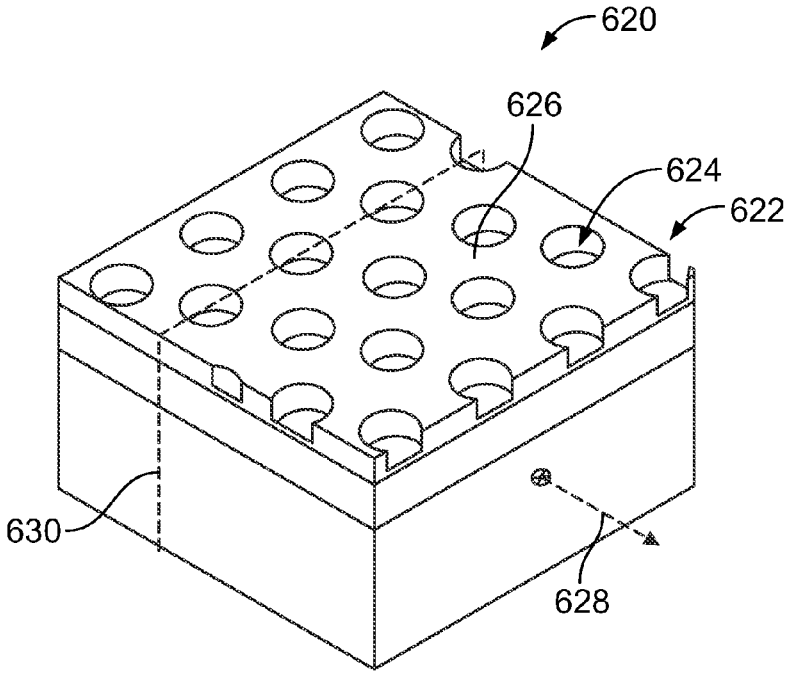
FIG. 9 is an isolated perspective view of a portion of an electrical contact formed in accordance with an embodiment.
Figure 10:
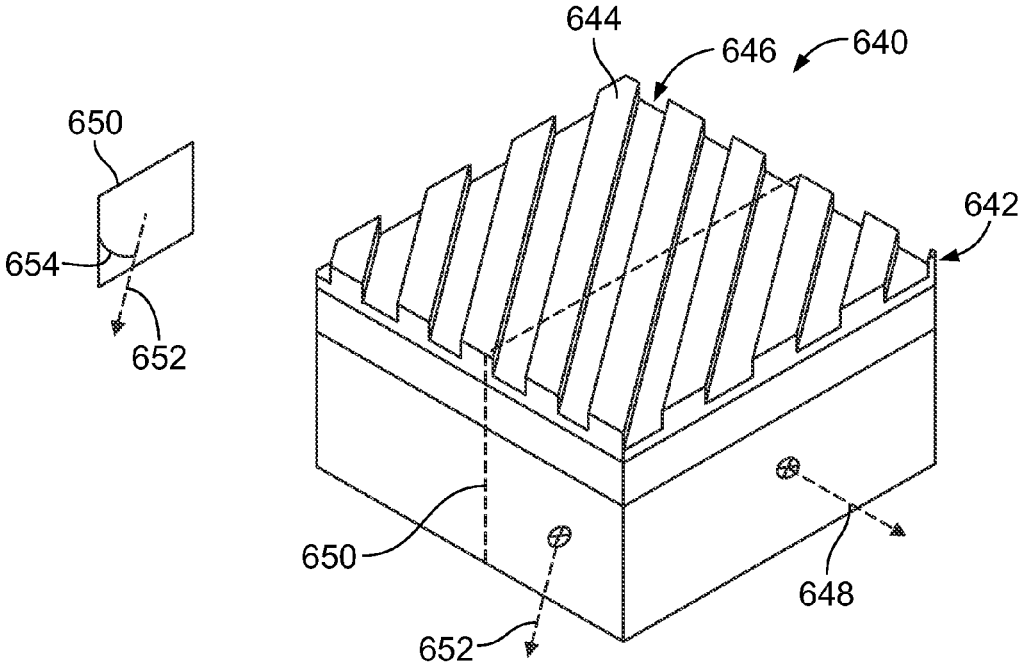
FIG. 10 is an isolated perspective view of a portion of an electrical contact formed in accordance with an embodiment.

FIGS. 8-10 illustrate different header contacts. For example, FIG. 8 is a perspective view of a portion of an electrical contact 600. The electrical contact 600 may be similar to the header contact 550 (FIG. 7). The electrical contact 600 may also be similar to the contact fingers 302, 304 (FIG. 4). The electrical contact 600 includes a base substrate 602, an underlying layer 604, and an outer plating 606. The outer plating 606 may be formed as described above and include cavities 608 and interstitial regions 610 that separate the cavities 608 from each other. The outer plating 606 may include a base layer 613 and a flash layer 614 that defines bottoms of the cavities 608. The cavities 608 are diamond-shaped and the outer plating 606 includes plating walls 612 that define the cavities 608. The plating walls 612 may be formed by the interstitial regions 610.

Also shown in FIG. 8, a longitudinal axis 616 extends through the electrical contact 600. The longitudinal axis 616 may extend between a proximal base (not shown) and a distal end (not shown) of the electrical contact 600, which may be similar to the proximal base 410 and the distal end 402 (FIG. 5), respectively, of the header contact 120 (FIG. 5). A portion of the outer plating 606 shown in FIG. 8 may represent a contact zone 617 of the electrical contact 600. During a mating operation, a mating interface of a mating contact (not shown) may engage the electrical contact 600 and slide or wipe along the electrical contact 600 in a mating direction 690 that is parallel to the longitudinal axis 616. When the mating contact has arrived at the final resting position with respect to the electrical contact 600, the mating interface may engage the contact zone 617. The mating interface would extend transverse to the longitudinal axis 616. More specifically, the mating interface would extend parallel to a cross plane 618 that is perpendicular to the longitudinal axis 616. As shown, the cross plane 618 intersects multiple cavities 608 and multiple interstitial regions 610. Accordingly, when the mating interface of the mating contact is in the final resting position at the contact zone 617, the mating interface may engage the outer plating 606 at multiple contact points to establish a sufficient electrical connection. The multiple contact points exist at the interstitial regions 610.

FIG. 9 is a perspective view of a portion of an electrical contact 620. The electrical contact 620 may be similar to the header contact 550 and the electrical contact 600. The electrical contact 620 includes an outer plating 622 having cavities 624 and interstitial regions 626 that separate the cavities 624. The cavities 624 are circular wells in the illustrated embodiment. As shown, a longitudinal axis 628 extends through the electrical contact 620, and a cross plane 630 may extend perpendicular to the longitudinal axis 628. The cross plane 630 intersects multiple cavities 624 and multiple interstitial regions 626. As described with respect to FIG. 8, a mating interface (not shown) of a mating contact (not shown) may extend parallel to the cross plane 630. The mating interface may engage the multiple interstitial regions 626 to form a plurality of contact points between the mating contact and the electrical contact 620.

FIG. 10 is a perspective view of a portion of an electrical contact 640. The electrical contact 640 may be similar to the header contact 550 (FIG. 7) and the electrical contacts 600, 620 (FIGS. 8 and 9, respectively). The electrical contact 640 includes an outer plating 642. As shown, the outer plating 642 includes interstitial regions 644 and cavities 646 defined between the interstitial regions 644. In the illustrated embodiment, the interstitial regions 644 form plating walls that extend parallel to one another. Each cavity 646 is defined between adjacent interstitial regions 644 (or plating walls). Also shown, a longitudinal axis 648 may extend through the electrical contact 640, and a cross plane 650 may extend transverse or perpendicular to the longitudinal axis 648. The cross plane 650 intersects multiple interstitial regions 644 and multiple cavities 646.

The cavities 646 form channels that extend parallel to a channel axis 652. The channel axis 652 may intersect the cross plane 650 and form a non-orthogonal angle 654 with the cross plane 650. The non-orthogonal angle 654 may be, for example, about 35° to about 45°. For illustration, the cross plane 650, the channel axis 652, and the non-orthogonal angle 654 are shown near the electrical contact 640.

Similar to other electrical contacts described herein, the electrical contact 640 is configured to engage a mating interface (not shown) that extends generally parallel to the cross plane 650. Embodiments such as those shown in FIG. 10 may substantially reduce a material volume of the outer plating 642 while also reducing a likelihood that the mating interface of the mating contact (not shown) will not establish a sufficient electrical connection. More specifically, the orientation of the interstitial regions 644 relative to the mating interface increase the likelihood that multiple contact points will exist between the mating interface and the electrical contact 640. The cavities 646 substantially reduce the material volume of the outer plating 642.

In each of the above embodiments the outer plating includes a uniform pattern of cavities and interstitial regions. In alternative embodiments, the outer plating may include a non-uniform pattern or multiple different patterns. For example, as the outer plating approaches the contact zone, the cavities may reduce in size and the interstitial regions may increase in size to increase the area of the exterior surface and, consequently, increase the likelihood that the exterior surface will sufficiently engage the mating contact.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a connector housing configured to engage a mating connector during a mating operation; and a plurality of electrical contacts coupled to the connector housing, each of the electrical contacts including a proximal base coupled to the connector housing and an elongated body that extends from the proximal base to a distal end, the elongated body including an outer plating that comprises a precious metal, the outer plating forming interstitial regions that define an array of cavities, the interstitial regions forming an exterior surface of the corresponding electrical contact that engages a corresponding contact of the mating connector during the mating operation, wherein the exterior surface for each of the plurality of electrical contacts is shaped to permit the corresponding contact of the mating connector to wipe along the exterior surface in a direction from the distal end toward the proximal base such that the corresponding contact slides over at least some of the cavities during the mating operation.

2. The electrical connector of claim 1, wherein the outer plating is disposed along an underlying layer and has a height measured relative to the underlying layer, the height of the outer plating at the cavities being at most 50% of the height of the outer plating at the interstitial regions.

3. The electrical connector of claim 1, wherein the outer plating is disposed along an underlying layer and has a height measured relative to the underlying layer, the height of the outer plating at the cavities being at most 20 microinches, the height of the outer plating at the interstitial regions being between 30 microinches and 100 microinches.

4. The electrical connector of claim 1, wherein the outer plating includes a base layer and a flash layer on the base layer, the flash layer being at most 10 microinches.

5. The electrical connector of claim 1, wherein a pore-blocking substance is disposed within the cavities.

6. The electrical connector of claim 1, wherein the outer plating occupies a plating volume, the cavities of the outer plating comprising at least 25% of the outer plating volume.

7. The electrical connector of claim 1, wherein the interstitial regions surround the cavities such that the cavities are separated from one another.

8. The electrical connector of claim 1, wherein the interstitial regions have top surfaces that form the exterior surface, the top surfaces being generally flat surfaces that extend parallel to an underlying layer of the electrical contact that is adjacent to the outer plating.

9. The electrical connector of claim 1, wherein a longitudinal axis extends through the elongated body between the proximal base and the distal end and wherein a cross plane extending perpendicular to the longitudinal axis intersects a plurality of the interstitial regions and a plurality of the cavities.

10. The electrical connector of claim 9, wherein the cavities form elongated channels that extend parallel to a channel axis, the channel axis forming a non-orthogonal angle with respect to the cross plane.

11. A communication system comprising:

a receptacle connector comprising a plurality of receptacle contacts; and a header connector comprising a plurality of header contacts that are configured to engage corresponding receptacle contacts of the receptacle connector during a mating operation between the receptacle and header connectors, each of the header contacts including a proximal base and an elongated body that extends from the proximal base to a distal end, the elongated body including an outer plating that comprises a precious metal, the outer plating forming interstitial regions that define an array of cavities, the interstitial regions forming an exterior surface of the corresponding header contact that engages the corresponding receptacle contact of the receptacle connector during the mating operation, wherein each of the receptacle contacts is configured to wipe along the corresponding exterior surfaces of the corresponding header contacts as the receptacle and header connectors are mated, wherein the exterior surface for each of the plurality of header contacts is shaped to permit the corresponding receptacle contact of the receptacle connector to wipe along the exterior surface in a direction from the distal end toward the proximal base such that the corresponding receptacle contacts slide over at least some of the cavities during the mating operation.

12. The communication system of claim 11, wherein the outer plating is disposed along an underlying layer and has a height measured relative to the underlying layer, the height of the outer plating at the cavities being at most 50% of the height of the outer plating at the interstitial regions.

13. The communication system of claim 11, wherein the outer plating is disposed along an underlying layer and has a height measured relative to the underlying layer, the height of the outer plating at the cavities being at most 20 microinches, the height of the outer plating at the interstitial regions being between 30 microinches and 100 microinches.

14. The communication system of claim 11, wherein the outer plating includes a base layer and a flash layer on the base layer, the flash layer being at most 10 microinches.

15. An electrical contact comprising:

a proximal base; and an elongated body that extends from the proximal base to a distal end, the elongated body including an outer plating that comprises a precious metal, the outer plating forming interstitial regions that define an array of cavities, the interstitial regions forming an exterior surface of the elongated body that is configured to engage a corresponding contact through a wiping action, wherein the exterior surface of the elongated body is shaped to permit the corresponding contact to wipe along the exterior surface in a direction from the distal end toward the proximal base such that the corresponding contact slides over at least some of the cavities during a mating operation.

16. The electrical contact of claim 15, wherein a longitudinal axis extends through the elongated body between the proximal base and the distal end and wherein a cross plane extending perpendicular to the longitudinal axis intersects a plurality of the interstitial regions and a plurality of the cavities.

17. The electrical contact of claim 15, wherein the outer plating is disposed along an underlying layer and has a height measured relative to the underlying layer, the height of the outer plating at the cavities being at most 50% of the height of the outer plating at the interstitial regions.

18. The electrical contact of claim 15, wherein the outer plating is disposed along an underlying layer and has a height measured relative to the underlying layer, the height of the outer plating at the cavities being at most 20 microinches, the height of the outer plating at the interstitial regions being between 30 microinches and 100 microinches.

19. The electrical contact of claim 15, wherein the outer plating includes a base layer and a flash layer on the base layer, the flash layer being at most 10 microinches.

20. The electrical contact of claim 15, wherein the interstitial regions have top surfaces that form the exterior surface, the top surfaces being generally flat surfaces that extend parallel to an underlying layer of the electrical contact that is adjacent to the outer plating.

* * * * *